US006361245B1

(12) United States Patent
Polivka

(10) Patent No.: US 6,361,245 B1
(45) Date of Patent: Mar. 26, 2002

(54) METHOD AND APPARATUS FOR CONSTRUCTING A TEMPORARY PARKING LOT

(75) Inventor: A. Basil Polivka, Warren, OH (US)

(73) Assignee: Center West Enterprises, Niles, OH (US)

( * ) Notice: Subject to any disclaimer, the term of this patent is extended or adjusted under 35 U.S.C. 154(b) by 0 days.

(21) Appl. No.: 09/534,740

(22) Filed: Mar. 24, 2000

(51) Int. Cl.[7] ..... E01C 5/00

(52) U.S. Cl. ..... 404/73; 404/32; 404/70; 404/82; 405/258.1

(58) Field of Search ..... 404/17, 18, 32, 404/35, 44, 45, 70, 73, 82; 405/15, 16, 17, 19, 36, 258.1; 428/57, 58

(56) References Cited

U.S. PATENT DOCUMENTS

| | | | | |
|---|---|---|---|---|
| 3,346,219 A | * | 10/1967 | Salyer et al. | 404/35 X |
| 4,896,993 A | * | 1/1990 | Bohnhoff | 404/35 X |
| 5,273,373 A | * | 12/1993 | Pouyer | 404/35 |
| 5,288,165 A | | 2/1994 | Dekker | 404/35 |
| 5,326,192 A | | 7/1994 | Freed | 47/9 |
| 5,377,447 A | | 1/1995 | Fritch | 47/33 |
| 5,527,128 A | | 6/1996 | Rope et al. | 404/35 |
| 5,720,135 A | * | 2/1998 | Paquette | 52/174 |
| 6,258,430 B1 | * | 7/2001 | Perlman | 428/57 |

* cited by examiner

*Primary Examiner*—David Bagnell
*Assistant Examiner*—Tara L. Mayo
(74) *Attorney, Agent, or Firm*—Tarolli, Sundheim, Covell, Tummino & Szabo L.L.P.

(57) ABSTRACT

A method of constructing a temporary vehicle parking lot (10) on a land area (12) comprises the steps of: providing a composite drainage material (20) through which water drains; and covering the land area (12) with the composite drainage material (20) so that the land area is underneath the composite drainage material. The composite drainage material (20) comprises a polymeric open mesh core (22) between first and second layers (24 and 26) of a non-woven geo-textile fabric. One (24) of the first and second layers contacts the land area (12). The other (26) of the first and second layers faces away from the land area (12) and provides a surface (50) on which vehicles may be parked. The composite drainage material (20) directs water which contacts the other layer (26) through the first and second layers (24 and 26), through the polymeric core (22) between the layers, and into the land area (12) covered by the composite drainage material (20).

12 Claims, 4 Drawing Sheets

METHOD AND APPARATUS FOR CONSTRUCTING A TEMPORARY PARKING LOT

TECHNICAL FIELD

The present invention is directed to a method and apparatus for constructing a temporary parking lot on a land area.

BACKGROUND OF THE INVENTION

The transportation industry often requires additional parking areas for temporary vehicle storage prior to vehicle transfer and/or distribution. Such parking areas are typically needed adjacent rail yards and automotive production facilities. These additional parking areas are frequently only needed for a relatively short period of time, such as two or three months. Hence, it is desirable to minimize the time and expenses associated with constructing the additional parking areas.

Traditionally parking lots are constructed by covering a land area with concrete or asphalt. These traditional construction methods provide a desirable hard surface for vehicles to be driven on, but are time-consuming and expensive. Further, covering the land area with concrete or asphalt can create complications in the project, such as having to construct a retention pond to deal with excess rain water.

Other less permanent methods for constructing parking lots are also known. These other methods include covering a land area with gravel, wood chips, or shredded rubber from recycled tires. These non-traditional methods reduce the time and expenses associated with constructing the parking areas. However, these methods do not provide the desired parking surface, and can lead to the vehicles being damaged. Such vehicle damage can range from scratches in a vehicle's paint to extensive body damage caused by vehicles sliding into one another when excessive rain washes away the gravel, wood chips, or shredded rubber, and turns at least a portion of the parking area into a mud pit.

SUMMARY OF THE INVENTION

The present invention is a method of constructing a temporary vehicle parking lot on a land area. The method comprises the steps of: providing a composite drainage material through which water drains; and covering the land area with the composite drainage material so that the land area is underneath the composite drainage material. The composite drainage material comprises a polymeric open mesh core between first and second layers of a non-woven geo-textile fabric. One of the first and second layers contacts the land area. The other of the first and second layers faces away from the land area and provides a surface on which vehicles may be parked. The composite drainage material directs water which contacts the other layer through the first and second layers, through the polymeric core between the layers, and into the land area covered by the composite drainage material.

The step of covering the land area includes the step of staking the composite drainage material to the land area. The step of covering the land area further includes the steps of: placing rolls of the composite drainage material adjacent one another; unrolling the rolls of the composite drainage material so that longitudinal edges of adjacent rolls adjoin one another; and joining the longitudinal edges of adjacent rolls to create a continuous surface of the composite drainage material.

The present invention further provides an apparatus for constructing a temporary vehicle parking lot on a land area. The apparatus comprises a composite drainage material through which water drains. The composite drainage material comprises a polymeric open mesh core between first and second layers of a non-woven geo-textile fabric. The composite drainage material is adapted to cover the land area so that the land area is underneath the composite drainage material. One of the first and second layers contacts the land area. The other of the first and second layers faces away from the land area and comprises a surface on which vehicles may be parked. The composite drainage material directs water which contacts the other layer through the first and second layers, through the polymeric core between the layers, and into the land area covered by the composite drainage material.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF PREFERRED EMBODIMENTS

Figure 1:
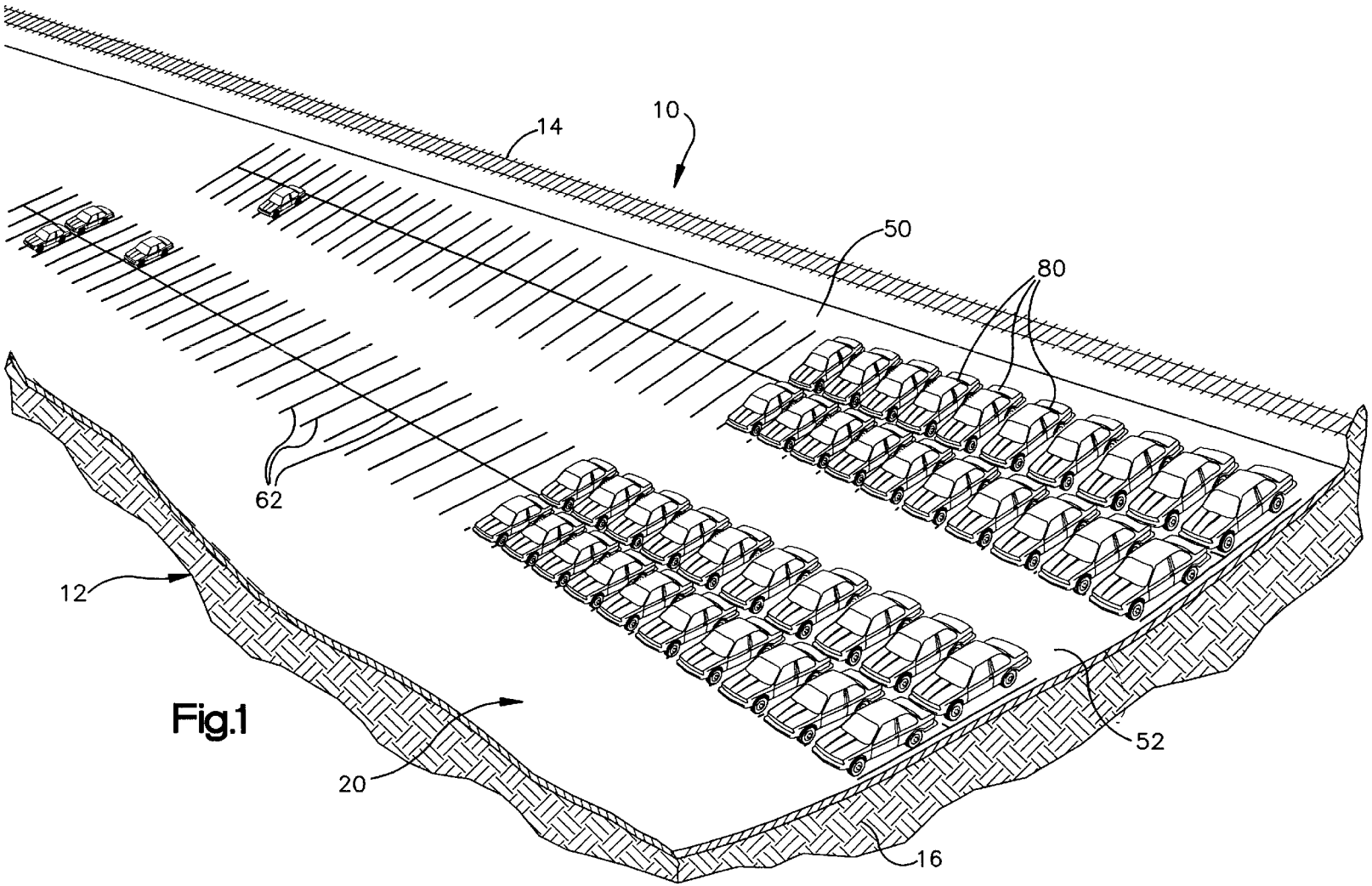
FIG. 1 is a schematic perspective view of a temporary parking lot constructed in accordance with the present invention.

The present invention is directed to a method and apparatus for constructing a temporary parking lot on a land area. As representative of the present invention, FIG. 1 illustrates a temporary parking lot 10.

The parking lot 10 is situated on a land area 12 adjacent railroad tracks 14. The land area 12 has been cleared of any trees and large shrubbery. Thus, the land area 12 comprises soil 16 and has an upper surface 18 (FIG. 2) which may be covered by grass or other vegetation (not shown). Preferably, the land area 12 is relatively flat.

Figure 3:
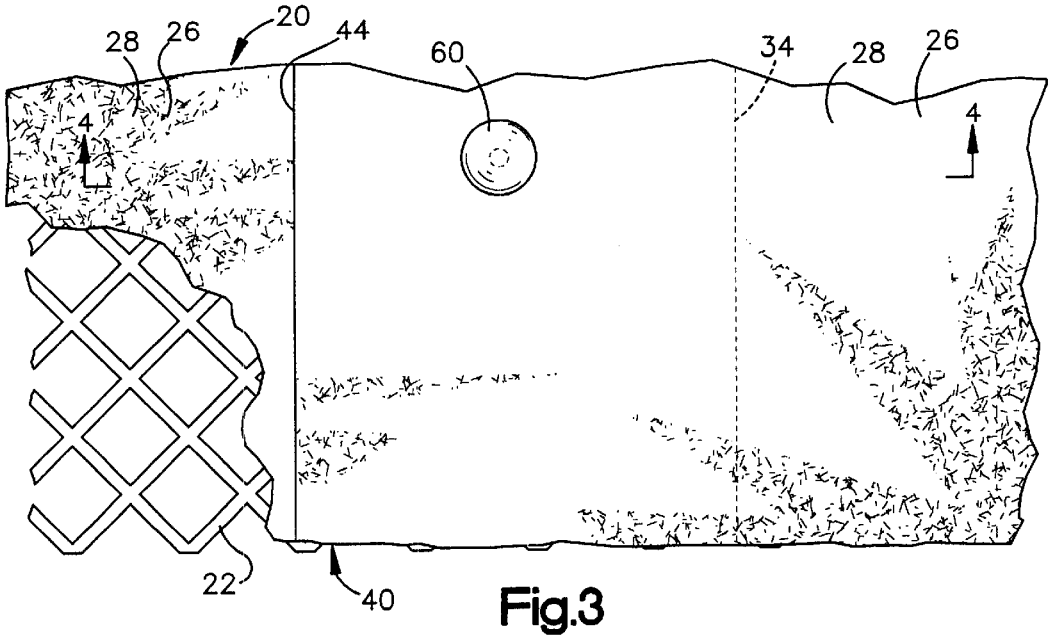
FIG. 3 is an enlarged plan view of a portion of the temporary parking lot shown in FIG. 1.

A composite material 20 through which water can drain is used to construct the temporary parking lot 10 on the land area 12. The composite drainage material 20 comprises a polymeric open mesh core 22 (FIG. 3) between first and second layers 24 and 26 (FIG. 5) of a non-woven geo-textile fabric. The core 22 is preferably 2–8 mm thick and is extruded from polyethylene resin.

The geo-textile fabric used for the first and second layers 24 and 26 is a continuous layer of a polypropylene material with an additive to help protect the fabric from the effects of ultra-violet light. The first and second layers 24 and 26 are water permeable, but are sufficiently dense to prevent solid matter, such as soil, from penetrating through the layers. Each of the first and second layers 24 and 26 is preferably 2–8 mm thick.

The polyethylene core 22 is placed between the first and second layers 24 and 26 and laminated using a heat process. The heat process fuses the core 22 to both layers 24 and 26 of the fabric to create the composite drainage material 20.

Figure 2:
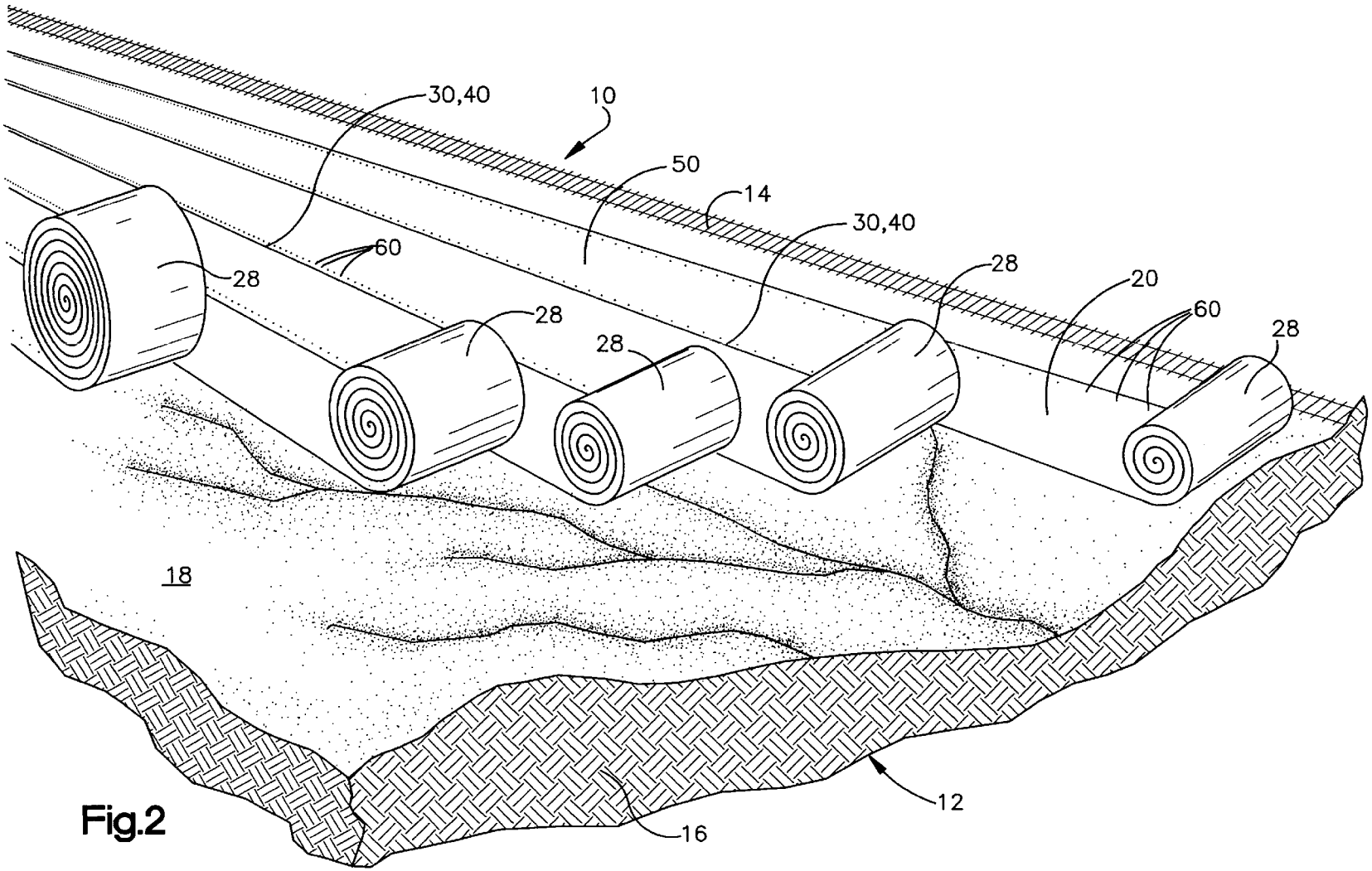
FIG. 2 is a schematic perspective view of the temporary parking lot of FIG. 1 during its construction.
Figure 4:
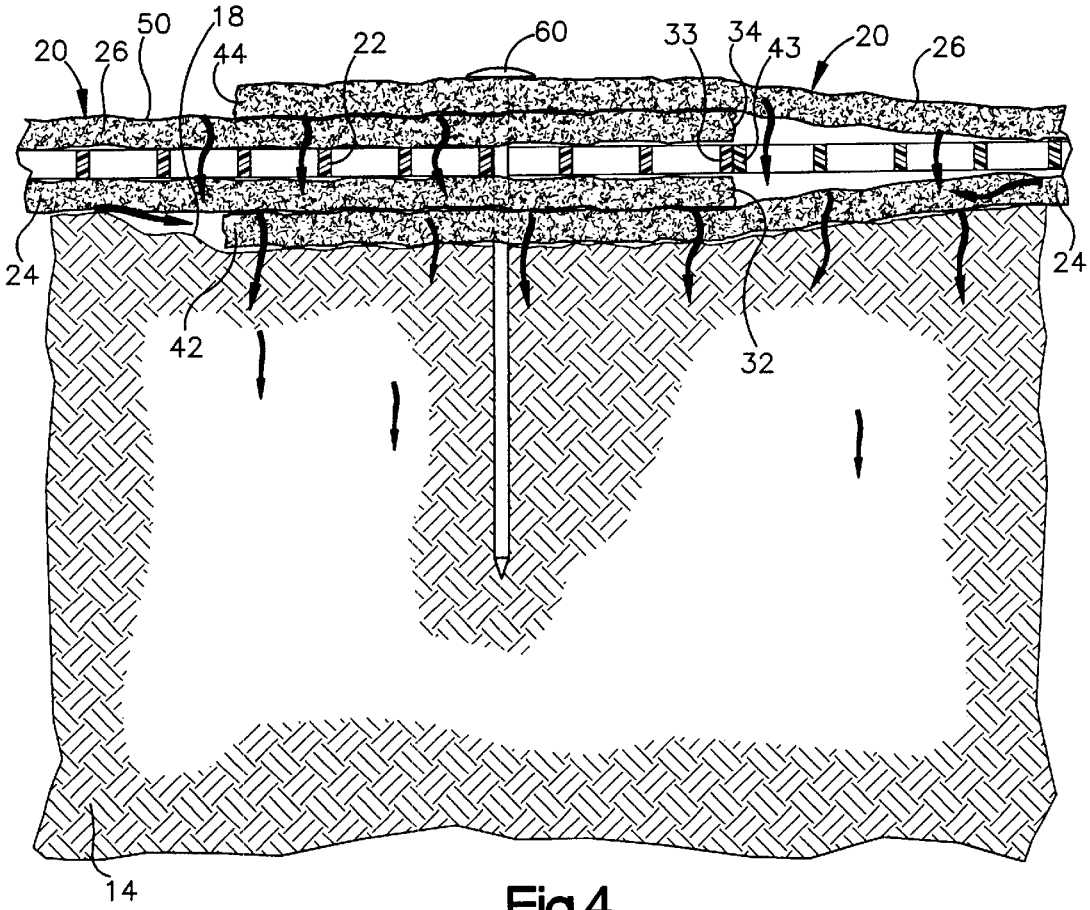
FIG. 4 is a sectional view taken along line 4—4 in FIG. 3.
Figure 5:
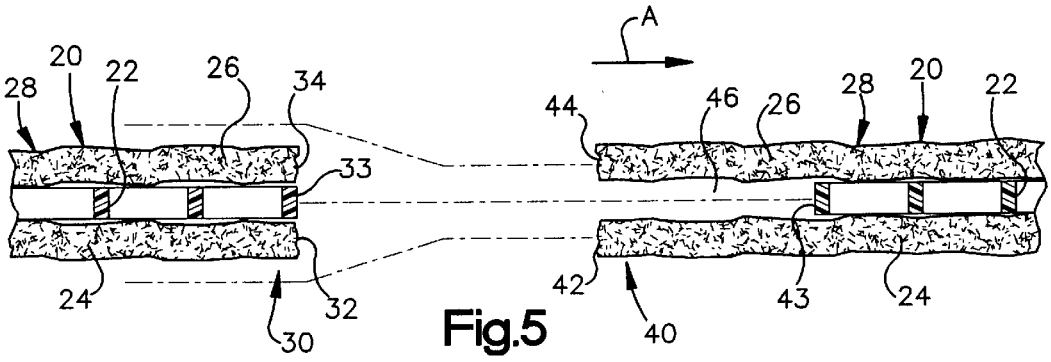
FIG. 5 is an exploded view of a portion of FIG. 4.

The composite drainage material 20 is formed in rolls 28, as shown in FIG. 2, for ease of shipping and installation. The composite drainage material 20 may be 7 to 12 feet wide, and up to 250 feet long when unrolled. Each roll 28 of the composite drainage material 20 has oppositely disposed first and second longitudinal edges 30 and 40 (FIG. 5). The first longitudinal edge 30 is formed by an edge portion 32 of the first layer 24, an edge portion 33 of the core 22, and an edge portion 34 of the second layer 26. In accordance with the preferred embodiment of the invention illustrated in FIGS. 3–5, the edge portions 32–34 are flush with one another.

The second longitudinal edge 40 is formed by an edge portion 42 of the first layer 24, an edge portion 43 of the core 22, and an edge portion 44 of the second layer 26. In accordance with the preferred embodiment illustrated in FIGS. 3–5, the edge portions 42 and 44 are flush with one another, while the edge portion 43 is recessed, in the direction of arrow A in FIG. 5. The edge portion 43 is recessed approximately 8–12 inches from the other edge portions 42 and 44, creating a cavity 46 in the second longitudinal edge portion 40.

To construct the temporary parking lot 10, several rolls 28 of the composite drainage material 20 are placed on the land area 12 adjacent one another. The rolls 28 of the composite drainage material 20 are then unrolled, as illustrated in FIG. 2, so that the first longitudinal edge 30 of one roll of the composite drainage material adjoins the second longitudinal edge 40 of an adjacent roll of the composite drainage material. The first fabric layer 24 of each roll 28 of the composite drainage material 20 contacts the upper surface 18 of the land area 12. The second fabric layer 26 of each roll 28 faces upward, away from the land area 12, and provides a surface 50 on which vehicles 80 (FIG. 1) may be parked.

The adjoining longitudinal edges 30 and 40 of adjacent rolls 20 are then joined together to create a continuous surface 52 of the composite drainage material 20. The adjoining longitudinal edges 30 and 40 of adjacent rolls 20 of the composite drainage material 20 are joined by first inserting the first longitudinal edge 30 into the cavity 46 in the second longitudinal edge 40, as is shown in FIG. 4. The first longitudinal edge 30 is inserted into the cavity 46 until the edge portion 33 of the core 22 in that roll 28 abuts the edge portion 43 of the core 22 of the adjacent roll 28. Next, a plurality of stakes 60 (FIG. 4) are driven through the junction of the longitudinal edges 30 and 40 of the composite drainage material 20 and into the soil 16 of the land area 12. As may be seen in FIG. 2, the stakes 60 are spaced apart along the longitudinal edges 30 and 40 of adjoining rolls 28 of the composite drainage material 20.

Finally, to complete the temporary parking lot 10, lines 62 (FIG. 1) are painted on the surface 52 on the second fabric layer 24 of the composite drainage material 20 to indicate a plurality of parking places for the vehicles 80.

As shown by the arrows in FIG. 4, the composite drainage material 20 directs water, such as rain, which contacts the surface 50 through the composite drainage material and into the soil 16 of the land area 12. The water flows through the second fabric layer 26, through the core 22, and through the first fabric layer 24. The combination of the core 22 and the fabric layers 24 and 26 function to disperse the water across a large section of the land area 12 so that normal ground water flow for the land area is maintained. This dispersion of the water obviates the need for a retention pond.

The core 22 in the composite drainage material 20 provides a sufficiently hard surface for the vehicles 80 to be driven on. Further, the heat fusion of the core 22 to the fabric layers 24 and 26 allows the composite drainage material 20 to withstand vehicle traffic, including turning of vehicle wheels, without the fabric layers becoming detached from the core. The geo-textile fabric of the first and second layers 24 and 26 stabilizes the soil 14 and traps the soil underneath the composite drainage material 20 to prevent large amounts of dirt and/or mud from penetrating to the upper surface 50 of the composite drainage material. Further, the continuous surface 52 formed by the overlapping joint between adjacent rolls 28 of the composite drainage material 20 also prevents dirt and/or mud from penetrating to the surface 50 between adjacent rolls. The composite drainage material 20 is reusable and has at least a two year useful life. Finally, the composite drainage material 20 is relatively inexpensive to manufacture and install.

Figure 6:
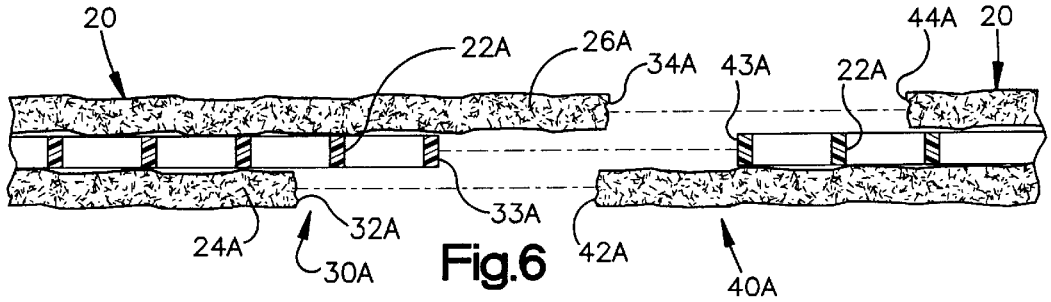
FIG. 6 is a view similar to FIG. 5 illustrating an alternate configuration.

FIG. 6 illustrates an alternate configuration for the longitudinal edges 30 and 40 of adjacent rolls of the composite drainage material 20. The suffix "A" is added to the reference numerals used in the prior embodiment to denote the alternate configuration. In FIG. 6, the first longitudinal edge 30A is formed by an edge portion 32A of the first layer 24A, and edge portion 33A of the core 22A, and an edge portion 34A of the second layer 26A. The edge portion 33A of the core 22A extends beyond the edge portion 32A of the first layer 24A, and the edge portion 34A of the second layer 26A extends beyond the edge portion 33A of the core.

The second longitudinal edge 40A has a complimentary shape formed by an edge portion 43A of the 22A which extends beyond the edge portion 44A of the second layer 26A, and an edge portion 42A of the first layer 24A which extends beyond the edge portion 43A of the core.

Figure 7:
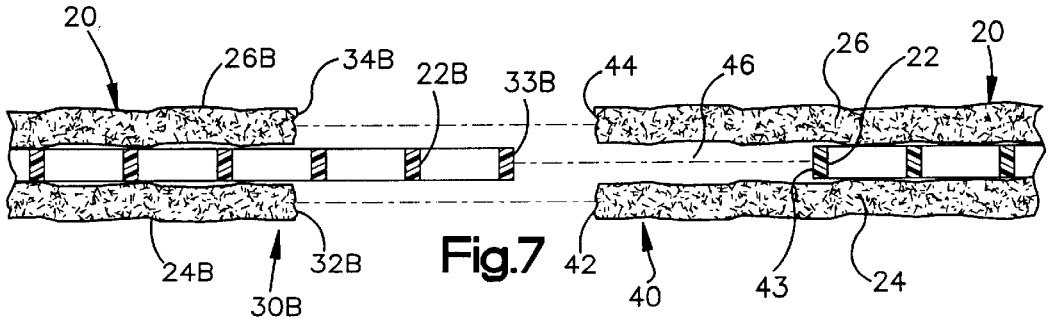
FIG. 7 is a view similar to FIG. 5 illustrating another alternate configuration.

FIG. 7 illustrates another alternate configuration for the longitudinal edges of adjacent rolls of the composite drainage material 20. The suffix "B" is added to the reference numerals used in the first embodiment in the alternate configuration of FIG. 7. The second longitudinal edge 40 is identical to that which is shown in FIG. 5. However, the first longitudinal edge 30B is formed by an edge portion 33B of the core 22B which extends beyond the edge portions 32B of the first layer 24B and the edge portion 34B of the second layer 26B. The extended edge portion 33B of the core 22B fits into the cavity 46 in the second longitudinal edge 40 to join adjacent rolls of the composite drainage material 20.

From the above description of the invention, those skilled in the art will perceive improvements, changes and modifications. Such improvements, changes and modifications within the skill of the art are intended to be covered by the appended claims.

Having described the invention, I claim:

1. A method of constructing a temporary automotive vehicle parking lot on a land area, said method comprising the steps of:

providing a composite drainage material through which water drains, said composite drainage material comprising a polymeric open mesh core between first and second layers of a non-woven geo-textile fabric;

covering the land area with said composite drainage material by placing rolls of said composite drainage material adjacent one another;

unrolling said rolls of said composite drainage material so that longitudinal edges of adjacent rolls adjoin one another;

overlapping at least a portion of said longitudinal edges of said adjacent rolls; and staking together said longitudinal edges of adjacent rolls to create a gapless and continuous surface of said composite drainage material so that the land area is underneath said composite drainage material, one of said first and second layers contacting the land area, the other of said first and second layers facing away from the land area and providing a surface on which automotive vehicles are parked, said composite drainage material directing water which contacts said other layer through said first and second layers, through said polymeric core between said layers, and into the land area covered by said composite drainage material.

2. The method of claim 1 further comprising the step of painting lines on said other layer of said composite drainage material to indicate a plurality of parking places for automotive vehicles.

3. The method of claim 1 further comprising, prior to said step of covering the land area, the step of heat-fusing said polymeric core between said first and second layers.

4. The method of claim 1 further comprising, prior to said step of covering the land area, the step of securing said other layer to said polymeric core to withstand automotive vehicle traffic directly on said other layer including turning of automotive vehicle wheels on said other layer without said other layer becoming detached from said polymeric core.

5. Apparatus for constructing a temporary automotive vehicle parking lot on a land area, said apparatus comprising:

a composite drainage material through which water drains, said composite drainage material comprising a polymeric open mesh core between first and second layers of a non-woven geo-textile fabric;

said composite drainage material being adapted to cover the land area so that the land area is underneath said composite drainage material, one of said first and second layers contacting the land area, the other of said first and second layers facing away from the land area and comprising a surface on which automotive vehicles are parked, said composite drainage material directing water which contacts said other layer through said first and second layers, through said polymeric core between said layers, and into the land area covered by said composite drainage material;

said composite drainage material being formed in rolls which are unrolled adjacent one another to cover the land, each of said rolls having longitudinal edges, at least a portion of said adjacent longitudinal edges of said rolls overlapping and being staked together at said overlapping portions by a plurality of stakes to form a continuous and gapless surface of said composite drainage material.

6. The apparatus of claim 5 wherein said plurality of stakes also secures said composite drainage material to the land.

7. The apparatus of claim 5 wherein said other layer of said composite drainage material includes lines which are paint ed on to indicate a plurality of parking p laces for automotive vehicles.

8. The apparatus of claim 5 wherein said polymeric core is heat-fused between said first and second layers of said composite drainage material.

9. The apparatus of claim 5 wherein said polymeric core is secured to said other of said first and second layers to withstand automotive vehicle traffic directly on said other layer including turning of automotive vehicle wheels on said other layer without said other layer becoming detached from said polymeric core.

10. The apparatus of claim 5 wherein said longitudinal edge of said one roll comprises said first and second layers and said polymeric core arrange flush with one another, and said longitudinal edge of said other roll comprises said polymeric core recessed from said first and second layers, said first layer of said longitudinal edge of said other roll overlapping said first layer of said longitudinal edge of said one roll; said second layer of said longitudinal edge of said other roll overlapping said second layer of said longitudinal edge of said one roll.

11. The apparatus of claim 5 wherein said longitudinal edge of said one roll comprises said first and second layers and said polymeric core having a stepped configuration, and said longitudinal edge of said other roll comprises said first and second layers and said polymeric core having a complimentary stepped configuration, said longitudinal edges of said rolls overlapping at said stepped configuration.

12. The apparatus of claim 5 wherein said longitudinal edge of said one roll comprises said first and second layers recessed from said polymeric core, and said longitudinal edge of said other roll comprises said polymeric core recessed from said first and second layers, said first and second layers of said longitudinal edge of said other roll overlapping said longitudinal edge of said polymeric core of said one roll and abutting said first and second layers of said longitudinal edge of said one roll.

* * * * *